US005113587A

United States Patent [19]

Loomis

[11] Patent Number: 5,113,587

[45] Date of Patent: May 19, 1992

[54] CUTTING INSTRUMENT

[76] Inventor: Stephen A. Loomis, 12956 Ave. 240, Tulare, Calif. 93274

[21] Appl. No.: 654,285

[22] Filed: Feb. 11, 1991

[51] Int. Cl.[5] ..... B25G 1/00; B26B 3/00; B26B 13/26

[52] U.S. Cl. ..... 30/340; 30/125; 30/315

[58] Field of Search ..... 30/86, 125, 315, 340, 30/344; 7/118, 167

[56] References Cited

U.S. PATENT DOCUMENTS

| | | | |
|---|---|---|---|
| 230,393 | 7/1880 | Barker et al. | 30/340 |
| 882,662 | 3/1908 | Andrews | 30/315 |
| 2,535,717 | 12/1950 | Bennett, Jr. | 30/315 |
| 3,890,707 | 6/1975 | Cremonese | 30/340 |
| 4,117,593 | 10/1978 | Piligrino | 30/315 |
| 4,306,323 | 12/1981 | Poore | 30/340 |

FOREIGN PATENT DOCUMENTS

| | | | |
|---|---|---|---|
| 2405261 | 8/1974 | Fed. Rep. of Germany | 30/125 |

*Primary Examiner*—Douglas D. Watts
*Assistant Examiner*—Paul M. Heyrana, Sr.
*Attorney, Agent, or Firm*—Dennis B. Haase

[57] ABSTRACT

An improved cutting instrument of the type having a blade and an extension thereof serving as a handle wherein the handle extends upwardly and inwardly at an acute angle with respect to the blade in order to permit the transmission of forces directly from the handle to the blade more efficiently.

6 Claims, 1 Drawing Sheet

CUTTING INSTRUMENT

The present invention relates to cutting instruments, and more particularly, improvements in culinary knives, although it will be appreciated that the invention has utility in other related fields.

BACKGROUND OF THE INVENTION

Since the memory of man runneth not to the contrary, kitchen knives and like cutting devices have come in one principal configuration. Specifically, the cutting instrument will comprise an elongated blade portion having a variety of shapes and sizes depending on a particular use, such as chopping or dicing. A holding device or handle attaches to the blade portion, and more often than not, forms an extension of the longitudinal axis of the blade. Whether the handle is a separate piece which is riveted or otherwise attached to the blade, or is integrally formed with the blade portion, almost without exception, it extends along or parallel to the longitudinal axis from its point of attachment.

The particular configuration described has two problems which are alleviated by the present invention. First, the instrument itself becomes much longer than is necessary or convenient for its efficient use, and, secondly, in most uses, the user finds that he must use one hand on the handle, and the other on the top of the blade in order to apply sufficient downward force to the cutting edge to accomplish the task at hand.

In the first instance, storage and handling of the instrument is complicated by its unnecessary length. In the second instance, the placement of the user's hand in close proximity to the cutting edge, results in an inherent and thoroughly unnecessary danger to the user, whose digits are placed in jeopardy in order to accomplish an otherwise simple task, which should be doable in complete safety.

DESCRIPTION OF RELATED ART

Applicant's survey of the prior art indicates almost no effective solutions to problems perceived and solved by the present invention.

Luzzi U.S. Pat. No. 2,527,018 appears to recognize the leverage problems inherent in cutting instruments of standard configuration. The Luzzi solution, however, is a "paper cutter" solution in which the free end of the cutting instrument is secured to and rotatable about a pivot point on a chopping block. In such devices, a greater percentage of the forces generated by the user on the handle are thus transmitted to the working edge of the blade to accomplish various tasks. However, while Luzzi certainly provides a device which protects the user's fingers, he also provides a device which is bulky, tough to clean and keep clean, and insidiously complicated, relative to the present invention, which adds to its expense and detracts from its successful use.

Gramann U.S. Pat. No. 4,574,479 is a pizza cutter, and while the handle tends to be parallel to the longitudinal axis of the device, the curvature of the handle delimits the amount of useful force that can be applied to the blade.

Hickory Farms of Ohio markets a cheese cutter, which is believed to be unpatented, which employs a blade having an elongated slot cut in it in close proximity to one end. A wooden handle is riveted to a portion of the blade above the slot, and the edge below and forward the slot is sharpened. While this cheese cutter bears some remote resemblance to applicant's improved instrument, it is uniquely different in its use and configuration, and actual use of the Hickory Farms cheese cutter has shown that the user, in many instances, must still use both hands to accomplish its intended task. Moreover, on thicker cheese rounds, the close proximity of the handle to the cutting edge results in interference between the hand and the cheese, or whatever is being cut by the instrument, causing unnecessary difficulty.

SUMMARY OF THE INVENTION

By way of summation, it is an objective of the present invention to provide a novel cutting instrument which permits the user to maximize the force applied at the handle transmitted to the cutting edge.

It is another objective of the present invention to provide an improved cutting instrument which eliminates the danger inherent in using conventional instruments by eliminating the necessity of the use of two hands, one of which would be in close proximity to the cutting edge of the instrument.

Finally, it is an objective of the present invention to provide a unique cutting instrument in which the configuration provides an efficient size for both storage and use, while eliminating interference between the being used, and the user's hand.

DESCRIPTION OF THE DRAWING

Having provided an overview of the present invention and its environment, reference will now be made to the drawings wherein.

DESCRIPTION OF A PREFERRED EMBODIMENT

Figure 1:
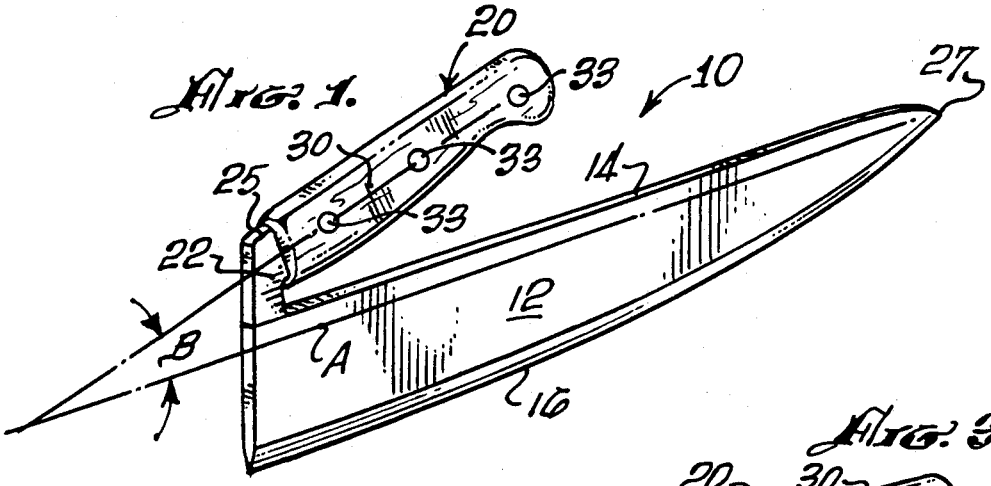
FIG. 1 is a perspective of a cutting instrument of the present invention, having a blade commonly referred to a chef's blade.

With reference now to the drawings, and initially FIG. 1 thereof, a cutting instrument constructed in accordance with the present invention is indicated at 10. The cutting instrument has a blade 12, having an upper edge and a lower edge 16, which is sharpened to define a cutting edge.

Attached to, or in the present instance initially intergrally formed with the blade 12, is an enlarged handle portion 20 which, in the illustrated case, has an integrally formed upstanding finger 22 which extends from joint 25 upwardly and inwardly towards the nose 27 of the blade 12. This upwardly and inwardly extending portion of the finger lies within the vertical plane of the place extended. An enlarged gripping section 30 is, in the illustrated case, secured to the finger 22 by means of rivets, or other suitable fasteners 33. It will be appreciated, however, that other forms of gripping means may be employed without departure from the invention.

As will be appreciated from the drawings, that portion of the handle 20 which projects upwardly and inwardly from the joint 25 is also parallel to the longitudinal axis A of the blade 12, and forms an acute angle B with that axis.

Figure 2:
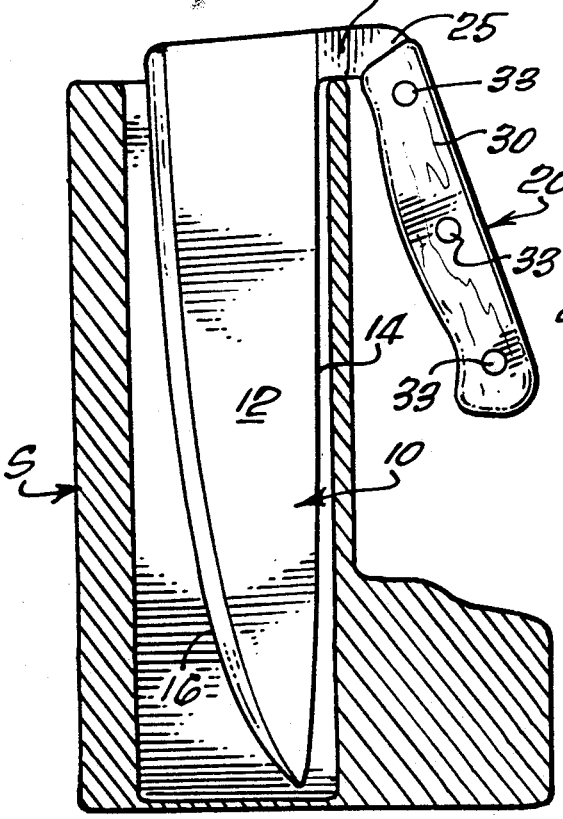
FIG. 2 is a side elevation of the instrument of FIG. 1 illustrating its storage advantages.

It has been found that there is no single precise angle which gives maximum results for all users and for all tasks. An acute angle B ranging between 50° and 15°, however, appears to give excellent results and accomplish the dual purpose of keeping the user's hand out of the way, while permitting the user to transfer forces applied directly to the handle to the cutting edge without use of a second hand. Naturally, the greater the acute angle, the lesser the percentage of forces which will be readily transferred to the cutting edge. With reference to FIG. 2, it will be appreciated that the cutting instrument of the present invention is conveniently stored in a storage block S in an exceptionally compact fashion. Storage in drawers and other places where such utensils are stored is equally efficient and compact.

Figure 3:
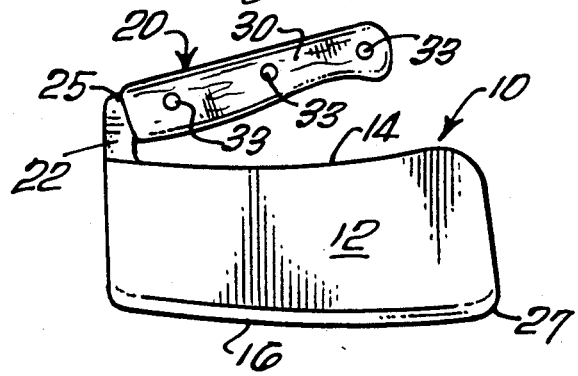
FIG. 3 is a side elevation of a clever employing the improvements of the present invention, and illustrating how the improved handle configuration works with a uniquely different blade.
Figure 4:
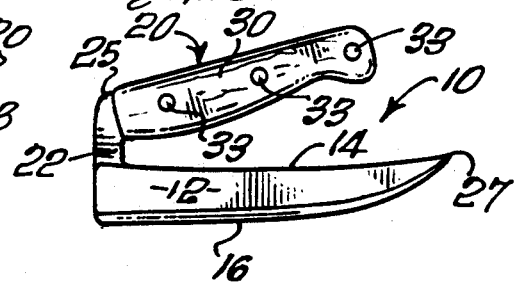
FIG. 4 is a side elevation of a utility knife configured in accordance with the present invention.

FIGS. 3 and 4 apply the principles of the present invention to different types of blades, and it will be appreciated that other blades, such as carving knives and bread knives would benefit equally from the nuances herein described.

Having described a preferred embodiment of my invention, what is claimed is:

1. In a cutting instrument, having a blade member with an edge thereof terminating in a nose portion, said edge being sharpened, means defining an upstanding finger attached to a flat portion of said blade at one end thereof, a handle attached to said finger, said handle extending upwardly toward said nose portion within the plane of said blade member at an acute angle of less than 45 degrees with respect to the upper edge of blade member such that downward force applied to said handle is transmitted directly to said sharpened edge.

2. The cutting instrument of claim 1, wherein an upstanding finger member is integrally formed between said handle and said blade, said handle having an enlarged portion attached thereto for gripping, said gripping portion being disposed above said blade in spaced relation thereto, and at an acute angle of less than 45 degrees with respect to said cutting edge of said blade.

3. The cutting instrument of claim 1, wherein said handle is disposed at an acute angle with respect to the longitudinal axis of said blade.

4. The cutting instrument of claim 2, wherein said handle is disposed at an acute angle with respect to the longitudinal axis of said blade.

5. A cutting instrument having a blade portion, and a handle portion attached at one end of said blade portion, said blade portion having an upper edge, and an opposite, relatively parallel lower edge, said lower edge being sharpened to define a cutting edge means defining an upstanding finger attached to a flat portion of said blade at one end thereof, said handle comprising an enlarged section configured to receive the user's hand in gripping relation, said enlarged portion being disposed at an acute angle of less than 45 degrees relative to said blade portion, and above the upper edge of said blade portion in the plane thereto, and in spaced relation thereto.

6. The cutting instrument of claim 5, wherein said handle is disposed at an acute angle with respect to the longitudinal axis of said blade.

* * * * *